US009635900B1

(12) United States Patent
Rolle et al.

(10) Patent No.: US 9,635,900 B1
(45) Date of Patent: May 2, 2017

(54) SHOE GLOVE

(71) Applicant: Gwendolyn Rolle, Vera Beach, FL (US)

(72) Inventors: Gwendolyn Rolle, Vera Beach, FL (US); Dong Xiao Peng, Winston-Salem, NC (US)

( * ) Notice: Subject to any disclaimer, the term of this patent is extended or adjusted under 35 U.S.C. 154(b) by 538 days.

(21) Appl. No.: 13/998,795

(22) Filed: Dec. 6, 2013

(51) Int. Cl.

| | |
|---|---|
| ***A43B 3/16*** | (2006.01) |
| ***A43B 3/02*** | (2006.01) |
| ***A43B 5/18*** | (2006.01) |
| ***A43B 13/22*** | (2006.01) |
| ***A43B 23/00*** | (2006.01) |
| ***A43B 3/24*** | (2006.01) |
| ***A43B 1/00*** | (2006.01) |
| ***A43B 3/18*** | (2006.01) |

(52) U.S. Cl.
CPC ..... *A43B 3/24* (2013.01); *A43B 1/0081* (2013.01); *A43B 3/16* (2013.01); *A43B 3/18* (2013.01)

(58) Field of Classification Search
CPC .... A43B 3/24; A43B 3/16; A43B 3/20; A43B 3/242; A43B 3/244; A43B 3/248; A43B 5/18; A43B 1/0081; A43B 3/18
USPC ..... 36/100, 101, 136, 7.1 R, 72 R, 7.2
See application file for complete search history.

(56) References Cited

U.S. PATENT DOCUMENTS 801,899 A * 10/1905 McQuiston ..... A43B 3/0031 36/1
2,013,700 A * 9/1935 Savale ..... A43B 3/20 36/1
2,078,732 A * 4/1937 Halmer ..... A43B 3/16 36/1
2,102,265 A * 12/1937 Halberstadt ..... A43B 3/16 36/7.3
2,171,654 A * 9/1939 Hinchliff ..... A43B 3/20 36/10
2,447,284 A * 8/1948 Bolte ..... A43B 3/18 36/7.2
2,479,006 A * 8/1949 Garth ..... A43B 3/16 36/7.3
2,901,842 A * 9/1959 De Lucia ..... A43C 11/006 36/72 R
3,141,247 A * 7/1964 MacKay ..... A43B 3/16 36/7.1 R (Continued)

OTHER PUBLICATIONS

Feb. 25, 2015 Declaration of Gwendolyn Rolle.

*Primary Examiner* — Jameson Collier

(57) ABSTRACT

Described herein is an improved shoe glove for reversible interchangeable placement upon a footwear item. Most preferably the shoe glove mechanically attaches to a pre-selected modified footwear item in a reversible and interchangeable manner. The shoe glove preferably completely covers the upper portion and sole of the footwear item. The shoe glove most preferably includes a (i) flexible shoe glove cover (ii) composite shoe glove sole and (iii) linear continuous stitched thread within a continuous stitching channel of the composite shoe glove sole. Most preferably the shoe glove attaching devices for attachment to a modified footwear item are hook and loop fastener material segments that reversibly attach a footwear item to the shoe glove. The improved shoe glove is sufficiently flexible that a single shoe glove can interchangeably and reversibly fit a range of footwear item sizes.

1 Claim, 9 Drawing Sheets

(56) References Cited

U.S. PATENT DOCUMENTS 3,221,421 A * 12/1965 Liebmann ..... A43B 3/0078 36/100
3,349,504 A * 10/1967 Shcarer ..... A43B 3/242 12/142 R
3,373,510 A * 3/1968 Memole ..... A43B 3/0078 36/100
4,713,895 A * 12/1987 Vallieres ..... A43B 3/24 36/1.5
4,785,556 A * 11/1988 Blair ..... A43B 3/16 36/7.1 R
4,850,122 A 7/1989 Schwab, Jr.
5,311,676 A * 5/1994 Hughes ..... A43B 3/24 36/100
5,544,430 A * 8/1996 Jacko ..... A43B 3/16 36/100
D413,711 S * 9/1999 Hicks, Jr. ..... D2/909
6,038,792 A * 3/2000 Hauter ..... A43B 5/02 36/133
6,339,888 B1 1/2002 Brunson et al.
6,584,704 B2 7/2003 March
7,165,342 B2 1/2007 Sheen
7,210,251 B1 5/2007 Rolle
D564,188 S 3/2008 Woodbury
7,383,646 B2 6/2008 Hall
8,316,563 B2 11/2012 Wegner
8,413,351 B1 * 4/2013 Watters ..... A43B 1/0054 36/100
8,789,297 B1 7/2014 Doyle et al.
2002/0066208 A1 * 6/2002 Hall ..... A43B 3/0078 36/7.3
2003/0088997 A1 * 5/2003 Mihailovich ..... A43B 3/16 36/7.1 R
2008/0092408 A1 * 4/2008 Yeung ..... A43B 1/0081 36/101
2008/0229615 A1 * 9/2008 Yu ..... A43B 3/24 36/100
2008/0235993 A1 * 10/2008 Wegner ..... A43B 3/20 36/101
2009/0126223 A1 * 5/2009 Metzger ..... A43B 7/12 36/7.1 R
2009/0272009 A1 * 11/2009 Weisner ..... A43B 3/101 36/102
2010/0126039 A1 * 5/2010 McClaskie ..... A43B 9/10 36/12
2011/0072691 A1 * 3/2011 Greer ..... A43B 3/16 36/72 R
2012/0227281 A1 * 9/2012 Young ..... A43B 19/00 36/10
2012/0324766 A1 * 12/2012 Pizzino ..... A43B 3/20 36/72 R
2013/0180127 A1 * 7/2013 Haslam ..... A43B 3/16 36/7.1 R
2013/0263468 A1 * 10/2013 Ciccarelli ..... A43B 3/16 36/7.1 R
2015/0000165 A1 * 1/2015 Reiff ..... A43B 13/22 36/72 R
2016/0106178 A1 * 4/2016 Monger ..... A43B 3/16 36/7.1 R

* cited by examiner

SHOE GLOVE

BACKGROUND OF THE INVENTION

Described herein is a shoe glove that preferably reversibly covers a footwear item to provide a decorative visual effect to match and compliment selected wardrobe items. More preferably the shoe glove is a structurally comprehensive shoe cover that preferably interchangeably and reversibly covers a footwear item to provide (i) a decorative visual effect and (ii) protection for the footwear item. Such a shoe glove most preferably can stretch to snugly but easily fit the exterior of a range of shoes, boots and sandals, and thereby compliment selected wardrobe items of the person wearing the covered shoes. Most preferably the shoe cover (i) can interchangeably and reversibly cover a single footwear item (ii) is sufficiently flexible to fit a range of footwear item sizes and (iii) is configured to flexibly fit a variety of footwear items such as, but not exclusively, "high heels," flat shoes and short boots.

The shoe glove is cut and sewn in a manner to hug the specific outer footwear contour. The shape of the footwear item can be selected from a variety of configurations including, but not exclusively, round, square and almond shape anterior toe portions. The shoe glove is a comprehensive shoe cover except for (i) an opening along the uppermost portion to insert the shoe and foot, and (ii) a smaller opening at the bottom posterior section of the shoe glove for insertion and exterior protrusion of a heel of a footwear item. In the most preferred embodiment the actual footwear item also includes (i) a single hook and loop fastener material segment along the posterior vertical midline of the footwear item and (ii) a single hook and loop fastener material segment located along the instep of the footwear item. These footwear item hook and loop fastener material segments preferably permanently attach to (i) aligning and corresponding hook and loop fastener material segments (ii) attached to a corresponding aligned shoe glove cover.

The prior art discloses other protective and decorative covers for footwear, which however, do not even generically include the features of the current shoe glove. For example, U.S. Pat. No. 5,778,564 (Kettner) discloses a removable cover for the upper portion of an athletic or sport shoe. This shoe covers attaches to the shoe's upper portion with hook and loop material fastener strips. However, Kettner is not suitable for most shoes because it comprises a tongue and eyelets for exclusively lace up style shoes. U.S. Pat. No. 4,850,122 (Schwab, Jr.) illustrates a shoe cover with a pouch comprising two lobes. One lobe covers a shoe exterior while the second lobe covers the shoe interior. The pouch is closed except for an opening at the shoe heel area into which the shoe toe is inserted and slides into proper alignment within the entire cover. However, the interior lobe unnecessary introduces an additional fabric layer that reduces comfort and otherwise prevents a perfect fit.

Similarly, U.S. Pat. No. 3,270,442 (Liebman and Memole) illustrates a decorative cover for high-heeled pumps with a shoe upper section attached to soft leather sole. The entire shoe cover is secured to the sole along the inner edges adjacent to the foot. A hollow cup with an opening at the bottom of the cup fits over the heel to complement the remainder of the cover. However, this shoe cover exclusively fits upon pumps of a specific narrow scope of existing footwear structure and design. Furthermore, the Liebman cover adhesive may fail from merely routine use.

U.S. Pat. No. 2,013,700 (Savale) discloses a dress shoe cover with an upper cover with corresponding openings at its top and bottom surfaces. There is a single flexible component that surrounds the opening at the bottom surface to fit over a shoe above the sole. There is also an elastic member between the sole and shank of the shoe to attach the cover sole to the shoe. However this attachment relies upon a spring wire and draw string attached in a manner so the cover may slide from the shoe exterior. U.S. Pat. No. Des. 322,152 (Irons) illustrates ornamentation for a shoe cover upon the shoe anterior, and that extends over the toe and tongue of the shoe. However this cover apparently only protects the anterior shoe, and therefore it results in uneven wear between the anterior and posterior of the shoe. Furthermore it is not clear from the design patent how Irons would attach a cover to the shoe.

U.S. Pat. No. 7,210,251 (Rolle) discloses a base component upon a modified shoe sole to which interchangeable covers attached. These cover are secured to the base component by two pairs of straps connected beneath the sole's lowermost surface. A removable and interchangeable heel is attached to the bottommost sole surface. Unfortunately this design leaves the most anterior positioned strap exposed directly beneath the ball of the foot within the shoe, and therefore the strap is mechanically susceptible to extreme wear and deterioration.

While these devices may fulfill their particular objective, they do not describe an interchangeable mechanically straightforward slip-on shoe glove with (i) protection of the sole stitching within a recessed channel (ii) a greatly improved stylish and aesthetic appearance and (iii) reversible attaching devices that further connect a footwear item to a corresponding enclosing shoe glove.

SUMMARY OF THE INVENTION

A preferred embodiment of the invention comprises a combination of a single interchangeable shoe glove. This preferred embodiment of the shoe glove also contains a stitching channel in the lower sole component of the composite shoe glove sole. This stitching channel preferably comprises a single continuous groove proximal to the periphery of the lower shoe glove sole component. The actual stitching comprises a thread that lies snugly within the base of the stitching channel whereby the channel walls protect the stitching from abrasion and wear during use. The protected stitches also mechanically attach the shoe glove lower sole component to the (i) flexible shoe glove cover and (ii) shoe glove upper sole component.

Also in this preferred embodiment, the shoe glove upper cover includes a continuous exterior edge by which the flexible fabric of the upper shoe cover is preferably tightly tucked between (i) a single lower sole glove component and (ii) a single upper shoe glove sole component. This continuous structural feature conceals the exterior edge of the lowermost sole component and provides a more refined, finished and elegant appearance. For the most pleasing aesthetic appearance, the shoe glove composite sole may also comprise a color of aquamarine blue along its bottommost surface. In other embodiments composite shoe glove sole has additional shoe glove sole component, or only one shoe glove sole component.

The present shoe glove functions as a footwear item cover and comprises a highly flexible an stretchable yet durable machine washable fabric which snugly fits a shoe, boot or other footwear. The present shoe glove invention also preferably includes a single longitudinal opening for insertion of the footwear item along the upper surface of the shoe glove. There is also a single opening, that is preferably round or oval in shape within the upper posterior portion of the shoe glove cover to accommodate (i) a heel of any height and (ii) a range of circular and cross-sectional heel dimensions. However, other shapes of this heel opening are also satisfactory in other embodiments of the invention.

In the most preferred embodiment of the invention, the shoe glove and footwear item attach to each other with reversibly attaching and aligned devices that are connected to the footwear item and the shoe glove. These attaching devices are most preferably reversibly attaching hook and loop fastener material segments. The shoe glove and footwear item attach to each other with reversibly attaching and aligning devices that are connected to the footwear item and the shoe glove. Most preferably, hook and loop fastener material strips (i) attach along the interior surface of the shoe glove cover and the composite shoe glove sole (ii) to prevent the shoe glove from slipping from the footwear item (ii) when shoe glove reversibly attaches to aligning hook and loop fasten material segments along a corresponding footwear item. However, in other embodiments a foot wear item is not modified to include complimentary attaching devices, including hook and loop fastener material segments that attach to a corresponding shoe glove. In these embodiments, the shoe glove has sufficient flexibility and strength to repeatedly snugly enclose a pre-selected footwear item without the assistance of attaching devices upon the combined shoe glove and footwear item.

Therefore, it is a purpose of the present invention to provide an economical manner in which to coordinate clothing with retrofitted footwear items.

It is another purpose of the present invention to provide an interchangeable device by which to completely cover a shoe with flexible decorative fabric and a composite sole component in a cost-effective manner.

It is another purpose of the present invention to provide an attached composite shoe glove sole to the decorative shoe upper cover by which attachment is not subjected to extensive and premature wear and deterioration.

It is another purpose of the present invention to provide a footwear cover device that can reversibly attach to a corresponding modified footwear item with attaching hook and look fastener material segments or other reversibly attaching devices.

These and other advantages will become apparent from the detailed description below and the attached drawings.

DETAILED DESCRIPTION OF THE MOST PREFERRED EMBODIMENT AND OTHER EMBODIMENTS

I. Structure and Design of Shoe Glove 1

Figure 1:
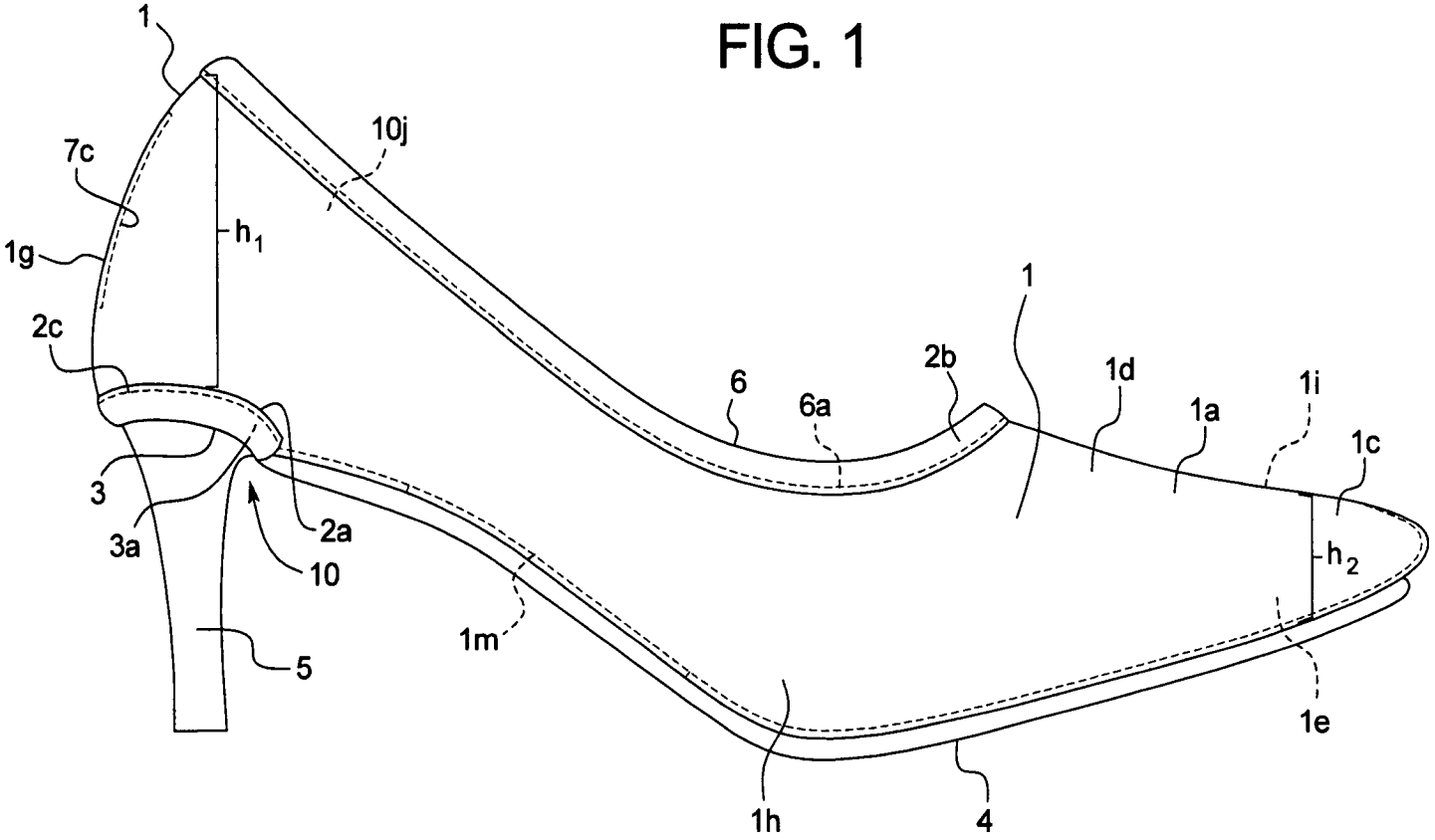
FIG. 1 illustrates a lateral view of most preferred embodiment of the improved shoe glove applied to a modified footwear item with an elevated heel.

Referring initially to FIG. 1, in the preferred embodiment a single shoe glove 1 of the present invention interchangeably, reversibly fits and snugly conforms to a single corresponding footwear item 10. Footwear items 10 are selected from, although not exclusively, the group consisting of shoes, sandals and boots, and with varying footwear heel 5 heights and dimensions. Shoe glove 1 can also snugly and aesthetically conform to standard footwear anterior toe shapes that include, but not exclusively: round toe, pointed, narrow square toe, wide square toe, open toe, almond toe and peep toe.

Figure 2:
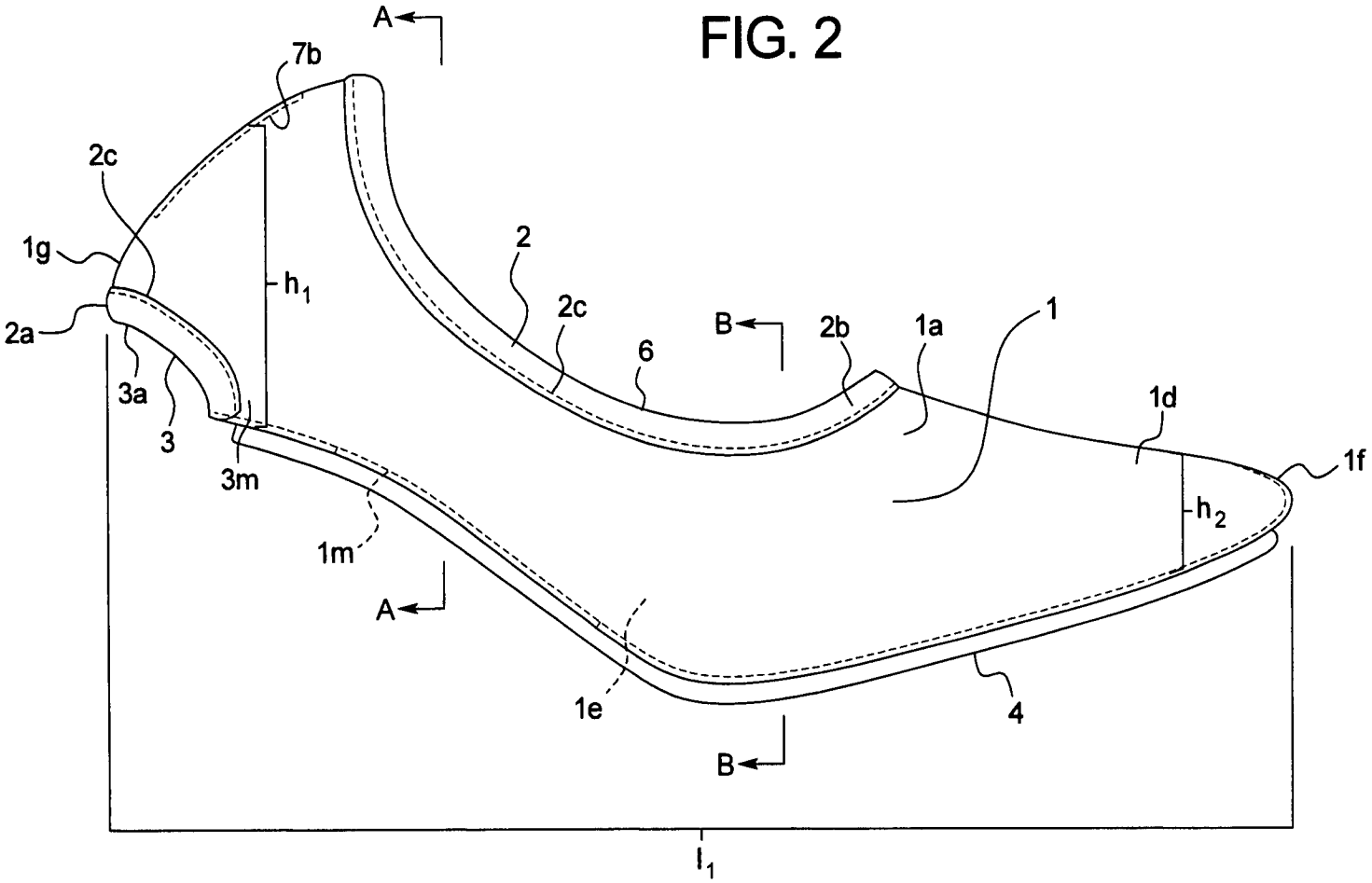
FIG. 2 illustrates a lateral isolated view of the shoe glove of FIG. 1 without an inserted footwear item.
Figure 3:
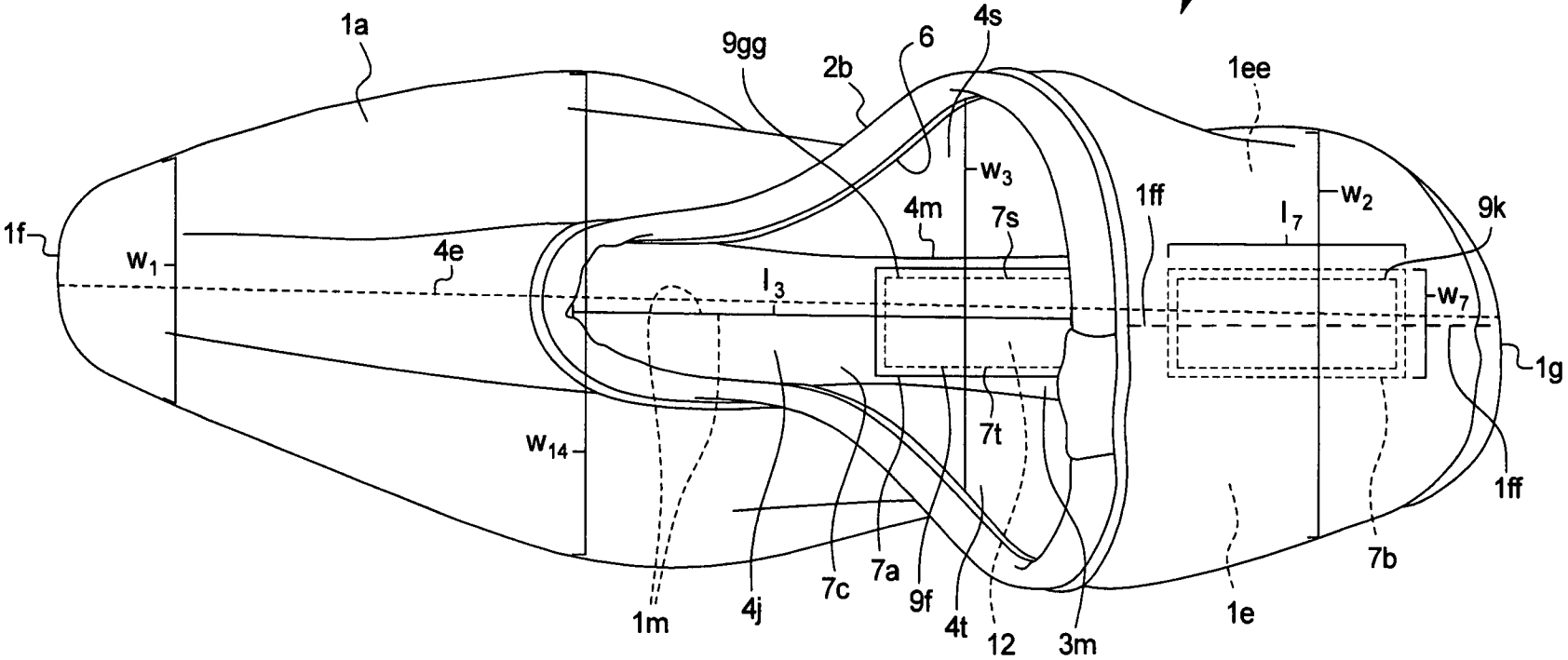
FIG. 3 illustrates an upper isolated plan view of the shoe glove with two hook and loop fastener material segments in the most preferred embodiment of FIG. 1.

Referring to FIGS. 2 and 3, a single isolated shoe glove 1 that is not extended upon a footwear item 10 preferably may be (i) nine and one-quarter inches in longitudinal length l1 (ii) one and seven-eighths inches in shoe glove width w1 at one and one-half inches posterior to anterior shoe glove end 1*f* and (iii) two inches in width w2 at one and one-half inches anterior to posterior shoe glove end 1*g*. When extended over a single footwear item 10, shoe glove 1 is preferably (i) three inches in maximum posterior vertical height h1 and (ii) two to three inches in maximum anterior height h2 (iii) for a footwear item 10 that is a United States size 7, 8 or 9. For these particular sizes, shoe glove 1 is preferably (i) four inches in shoe glove width w1 and (ii) ten inches in shoe glove longitudinal length w1 when extended over United States footwear sizes 7, 8 or 9.

Referring to FIG. 1, for United States footwear sizes 5 and 6, shoe glove 1 is preferably (i) two and one-quarter inches in maximum posterior vertical height h1 and (ii) one and one-half inches in maximum anterior vertical height h2 (iii) when properly placed upon a single footwear item 10. For these particular sizes, shoe glove 1 is preferably (i) one and one-half to three inches in maximum anterior width w14 and (ii) six and one-half to nine- and one-half inches in maximum longitudinal length 1 when properly placed upon a single footwear item 10. Most preferably each shoe glove 1 stretches to fit a footwear item 10 that is one size larger than the size for which that particular shoe glove 1 was originally intended. For example, a singe shoe glove 1 created for a size 6 footwear item 10 can be comfortably and easily worn upon a size 7 of the same footwear item 10. In other embodiments, shoe glove 1 may comprise other sizes and dimensions.

Referring to FIGS. 1, 2 and 3, each shoe glove 1 preferably includes a single (i) upper flexible fabric shoe glove cover 1*a* and (ii) composite shoe glove sole 4. Upper flexible fabric shoe glove cover 1*a* is preferably cut and sewn to match the three-dimensional shape of a range of footwear items 10 with diverse dimensions and shapes. Shoe glove cover 1*a* preferably has a (i) single exterior cover component surface 1*d* and (ii) single interior cover component surface 1*e*. Flexible fabric 1*c* comprising upper shoe glove upper cover 1*a* (i) is preferably selected from the group of materials consisting of flexible polyesters, dot polyesters and spandex and (ii) is most preferably hand-washable and moisture resistant. Flexible fabric 1*c* is preferably one-eighth inch in thickness.

Figure 4:
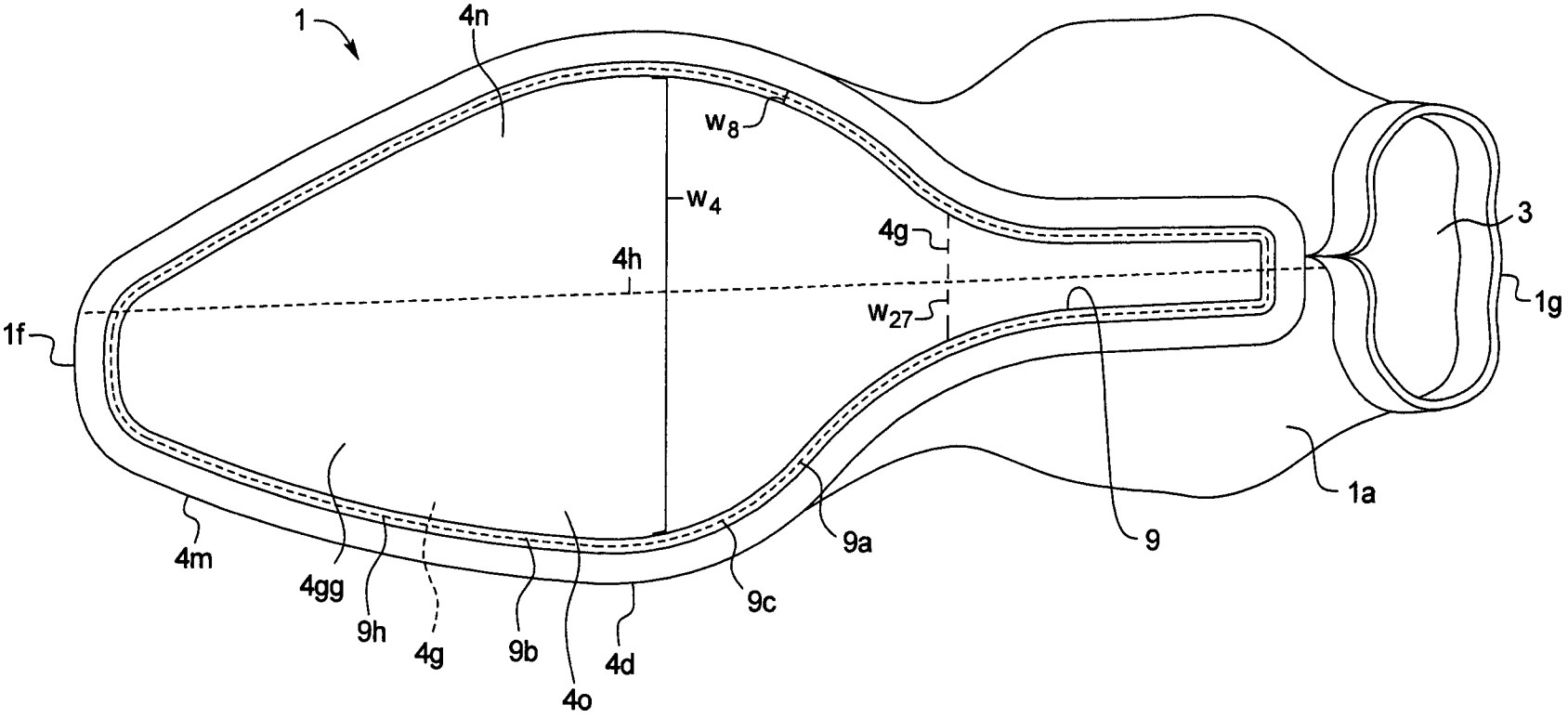
FIG. 4 illustrates a lower plan view of the shoe globe of FIG. 1 with stitching channel.

Referring to FIGS. 1, 2 and 4, each upper shoe glove cover 1*a* preferably contains a single shoe glove heel opening 3 at single posterior shoe glove end 1g, and from which a single heel 5 of a corresponding footwear item 10 can protrude. Shoe glove heel opening 3 is preferably approximately (i) circular in shape and (ii) one and one-quarter inches in diameter. Each shoe glove upper cover 1*a* also has a single continuous flexible exterior edge 1*m*. Single continuous exterior flexible edge 1*m* is preferably (i) flexible (ii) continuous and forms the perimeter of shoe glove cover 1*a*, single continuous exterior flexible edge 1*m* is also preferably (i) folded, 'sandwiched' and otherwise continuously positioned between (ii) preferably vertically first and second shoe glove sole upper and lower components 4*c*, 4*d* respectively as described infra.

Shoe glove 1 also has a first lateral shoe glove side 1*h* and a second lateral shoe glove side 1*i*. Shoe glove 1 also preferably includes a reinforcing posterior tab 2*o* attaching to second shoe glove piping 2*b* at posterior vertical midline 2*ff* of shoe glove 1.

Referring to FIGS. 1, 2, 3, 5 and 6, upper shoe glove cover 1*a* contains shoe glove cover longitudinal opening 6, through which footwear item 10 inserts in a longitudinal manner prior to use. Most preferably flexible upper shoe glove cover 1*a* resembles a low-cut stocking from which a single footwear item heel 5 can reversibly protrude through heel opening 3. In non-stretched isolated configuration without an inserted footwear item 10, shoe glove longitudinal opening 6 is preferably (i) five inches in maximum longitudinal length l3 and (ii) one inch in maximum width w3.

Referring to FIGS. 1, 2 and 3, first and second shoe cover pipings 2*a*, 2*b* respectively preferably are each made from the same flexible fabric 1*c* as upper shoe glove cover 1*a* and reinforcing posterior strip 2*o*. First and second shoe cover pipings 2*a*, 2*b* respectively each continuously cover two distinct and separate structures: (i) heel opening exterior edge 3*a* and (ii) footwear longitudinal exterior opening edge 6*a* respectively. Shoe cover pipings 2*a*, 2*b* each comprise a continuous linear stitch 2*c* along (i) single continuous heel opening exterior edge 3*a* and (ii) footwear longitudinal exterior opening edge 6*a*. Shoe cover pipings 2*a*, 2*b* each serve as a reinforcing edge material that (i) prevents flexible fabric 1*c* from premature fraying and (ii) adds strength to heel opening exterior edge 3*a* and footwear longitudinal opening exterior edge 6*a* whenever footwear item 10 inserts into shoe glove 1.

Figure 2B:
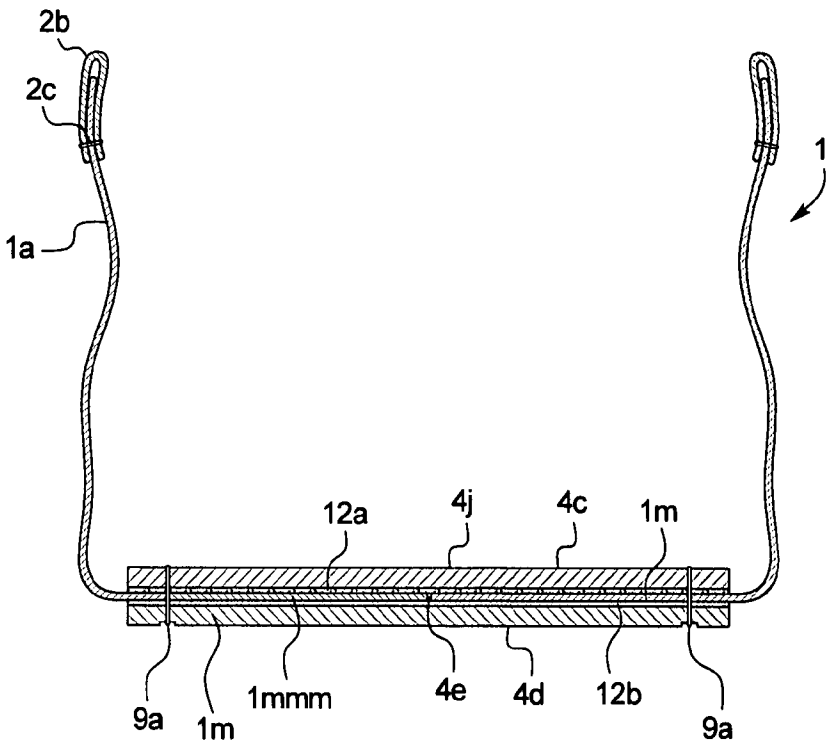
FIG. 2B illustrates a sectional view of the shoe glove of FIG. 1 along line B-B of FIG. 2.
Figure 2A:
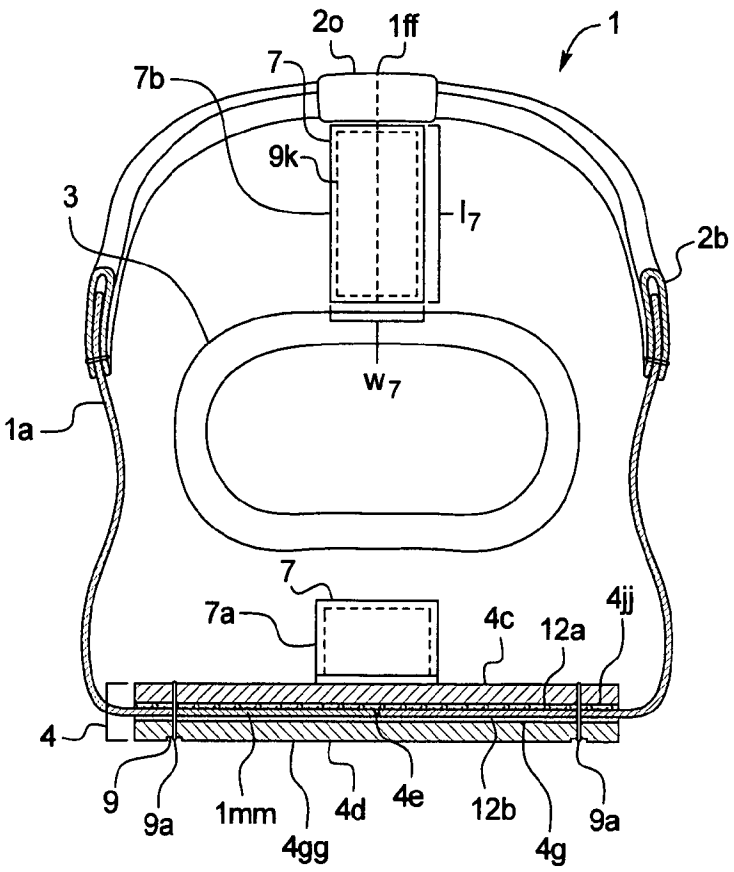
FIG. 2A illustrates a sectional view of the shoe glove of FIG. 1 along line A-A of FIG. 2.

Referring to FIGS. 1, 2, 2A, 2B and 5, each shoe glove 1 preferably comprises a corresponding single composite shoe glove sole 4. Single composite shoe glove sole 4 in turn preferably comprises a (i) single upper shoe glove sole component 4*c* and (ii) a single lower shoe glove sole component 4*d* and (iii) a shoe glove composite component exterior continuous edge 4*m*. Upper shoe glove sole component 4*c* preferably has a (i) first single anterior sole component end 4*k* and (ii) first single posterior sole component end 4*l*. Each lower shoe glove sole component 4*d* preferably has a (i) single second anterior sole component end 4*kk* and (ii) a second single posterior sole component end 4*ll*. Upper shoe glove sole component 4*c* also preferably contains a (i) single first upper sole component surface 4*j* and (ii) single first lower sole component surface 4*jj*. Lower shoe glove sole component 4*d* preferably comprises a single (i) a single second upper sole component surface 4g and (ii) a single second lower sole component surface 4*gg*. Composite shoe glove sole 4 preferably attaches to shoe glove 1 one-quarter inch posterior to shoe glove anterior end 1*f*. As best seen in FIGS. 2A and 2B, flexible shoe glove cover 1*a* preferably (i) continuously protrudes from composite shoe glove sole 4 all along flexible exterior shoe glove edge 1*m* and (ii) thereby provides an aesthetically pleasing shoe cover fabric 1*c* periphery.

Upper shoe glove sole component 4*c* and lower shoe glove sole component 4*d* each measure preferably (i) seven to nine inches in longitudinal length l4, l5 respectively and (ii) three and one-eighths inches in maximum width w4, w5 respectively. A shorter composite shoe glove sole 4 also satisfactory when sole 4 is approximately six to six and one-half inches in longitudinal length l4, l5 for a tighter fit. Other longitudinal lengths are also satisfactory in other embodiments. Upper shoe glove sole component 4*c* and lower shoe glove sole component 4*d* are each preferably one-eighth inch in thickness. Upper shoe glove sole component 4*c* is preferably made of flexible polyesters, dot polyesters, or spandex that is hand washable and moisture resistant. Lower shoe glove sole component 4*d* is preferably made of rubber or other standard man-made material that mimics rubber in macro materials properties.

Composite shoe glove sole 4 preferably continuously tapers from composite sole maximum widths w4, w5 (w4, w5 each preferably three inches) to upper and lower shoe glove sole component posterior ends 4*l*, 4*ll* respectively. Tapering 4*q* preferably ends at a minimum taper width w25 of one and one-quarter inch. In other embodiments, upper and lower shoe glove sole components 4*c*, 4*d* do not congruently align vertically as they do in the preferred and most preferred embodiments.

Preferably upper shoe glove sole component 4*c* and lower shoe glove sole component 4*d* vertically and congruently align so (i) lower shoe glove sole component 4*d* is the component on which the user will walk (ii) when a footwear item 10 is inserted into shoe glove 1. Upper shoe glove sole component 4*c* and lower shoe glove sole component 4*d* preferably congruently align with each other in this vertical alignment whenever shoe glove 1 is properly assembled. Neck width w27 of shoe glove composite sole neck 4*q* is preferably (i) one and one-half inches and (ii) neck 4*q* is preferably positioned five inches from shoe glove lower and upper shoe glove sole component anterior ends 4*k*, 4*kk* respectively.

Figure 5:
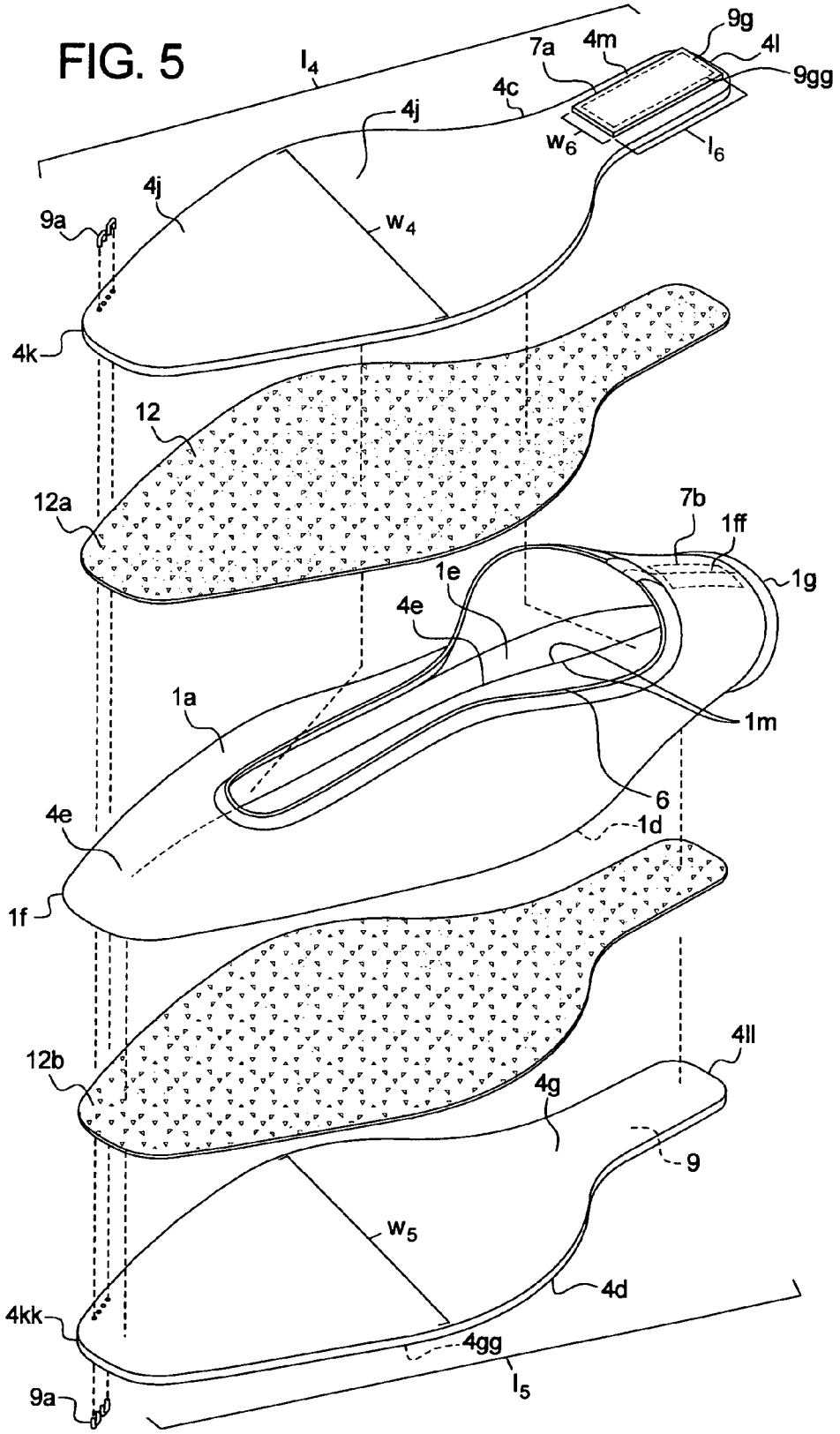
FIG. 5 illustrates an exploded view of the shoe glove of FIG. 1.

As best seen in FIGS. 2A, 2B and 5, continuous shoe glove cover exterior edge 1*m* continuously insert between upper shoe glove sole component 4*c* and lower shoe glove sole component 4*d* to form a continuous aesthetically pleasing exterior contour to shoe glove 1. As best seen in FIGS. 2A, 2B and 3, two opposing edge segments 1*mm*, 1*mmm* of shoe glove cover exterior edge 1*m* preferably (i) bend at approximate right angles to contiguously contact each other (ii) to form centrally positioned shoe glove cover longitudinal midline 4*e*. Shoe glove cover longitudinal midline 4*e* longitudinally bisects shoe glove cover 1*a* to form two equal longitudinal portions 4*s*, 4*t*. Preferably shoe glove cover longitudinal midline 4*e* congruently aligns with shoe glove sole longitudinal midline 4*h*. Shoe glove sole longitudinal midline 4*h* preferably bisects composite sole 4 into two equal longitudinal components 4*n*, 4*o*. Please see FIG. 4.

Shoe glove cover exterior edge 1*m* most preferably attaches to and between (i) upper shoe glove sole component 4*c* and lower shoe glove sole component 4*d* (ii) with linear continuous stitching 9*a* and adhesive 12. Most preferably adhesive 12 is a master cement adhesive of industrial strength that is well known in the footwear industry. Continuous stitching 9*a* preferably continuously binds lower shoe glove sole component 4*d* to (i) sandwiched intervening and vertically aligned flexible shoe glove cover exterior edge 1*m* and (ii) upper shoe glove sole component 4*c*. Referring to FIGS. 2A, 2B, two opposing segments 1*mm*, 1*mmm* of flexible shoe glove cover exterior edge 1*m* contiguously meet to form a centrally positioned shoe glove longitudinal sole midline 4*e* between lower shoe glove sole component upper surface 4*g* and upper shoe glove sole component lower surface 4*jj*. In this configuration, opposing segments 1*mm*, 1*mmm* of flexible cover exterior edge 1*m* continuously and contiguously contact each other along shoe glove longitudinal sole midline 4*e*.

Referring to FIGS. 2A, 3 and 4, the more preferred embodiment shoe glove 1 comprises hook and loop fastener material segments 7 that permanently attach to shoe glove 1. However, in other embodiments (i) hook and loop fastener material segments 7 reversibly attach to shoe glove 1 and/or (ii) other attaching devices 20 are used in place of hook and loop fastener material segments 7. Hook and loop material fastener segments 7 or other attaching devices 20 on shoe glove 1 can (i) permanently or reversibly (ii) attach to a pre-selected footwear item 10 as described in more detail below. Most preferably a single first hook and loop fastener material segment 7*a* is (i) rectangular in shape and (ii) attaches to shoe glove upper sole component upper surface 4*j* by adhesive 12 and linear continuous heel stitching 9*g*. Each heel stitch 9*gg* is preferably one-eighth inch in length.

Referring to FIGS. 4 and 5, single first hook and loop fastener material segment 7*a* is preferably (i) one and one-half inches in length l6 (ii) one inch in width w6 and (iii) one-quarter inch in thickness. When properly attached to shoe glove upper sole component upper surface 4*jj* (i) first hook and loop fastener material segment 7*a* has first and second shoe glove upper sole longitudinal fastener edges 7*s*, 7*t* respectively (ii) with each edge 7*s*, 7*t* parallel to shoe glove continuous composite sole exterior edge 4*m*.

First hook and loop fastener material segment 7*a* preferably (i) permanently attaches with heel stitching 9*g* to shoe glove upper sole component upper surface 4*j* (ii) contiguously with shoe glove sole component upper posterior end 4*l* and (iii) longitudinally aligned along centrally positioned shoe glove sole longitudinal midline 4*h*. However, in other embodiments, attachment of first hook and loop fastener material segment 7*a* to shoe glove 1 can be by (i) solely adhesive 12 or (ii) adhesive 12 and stitching 9*g*. The preferred adhesive 12 is master cement adhesive that is industrial strength and well known in the footwear industry.

As best seen in FIG. 3, single second hook and loop fastener material segment 7*b* is preferably (i) two inches in length l7 (ii) one-eight to one-quarter inch in width w7 and (iii) one-eighth inch in thickness. Second hook and loop fastener material segment 7*b* is preferably (i) rectangular in shape and (ii) permanently attaches to shoe glove cover posterior interior surface 1*ee* (ii) with adhesive 12 and stitching 9*k* along (iii) longitudinal shoe glove cover posterior interior surface vertical midline 1*ff* (iv) contiguous and adjacent to second shoe glove piping 2*b*. In other embodiments second hook and loop fastener material segment 7*b* attaches to posterior shoe glove cover interior surface 1*ee* either (i) exclusively by adhesive 12 or (ii) exclusively by stitching 9*k*. In other embodiments second hook and hoop fastener material segment 7*b* is positioned at another location along posterior shoe glove cover interior surface 1*ee*. In still other embodiments of shoe glove 1 (i) there are no attached first or second hook and loop fastener material segments 7*a*, 7*b* respectively, nor (ii) are there any other hook and hook fastener material segments 7 or fasteners 20 that are not hook and loop fastener material segments 7.

As best seen in FIGS. 2A, 2B, 4 and 5, flexible upper shoe glove cover 1*a* preferably permanently attaches to upper shoe glove sole component 4*c* and lower shoe glove sole component 4*d* by (i) both upper and lower adhesive layers 12*a*, 12*b* respectively and (ii) stitching 9*a*. In this manner, shoe glove 1 can be repeatedly removed or placed over footwear item 10 without inadvertent detachment of shoe glove composite sole 4 from shoe glove cover 1*a*. Most preferably within lowermost sole component lower surface 4*gg* lays single continuous stitching channel 9. Single continuous stitching channel 9 is preferably (i) molded or cut proximal to exterior sole edge 4*m* of bottom shoe glove sole component lower surface 4*gg*.

Stitching channel 9 is preferably (i) one-eighth to three-eighths inch from lower shoe glove sole exterior edge 4*m* (ii) 1/32 to one-sixteenth inch in depth and (iii) one-eighth to one-fourth inch in width w8. Stitching channel base floor 9*b* is also preferably flat and smooth. Stitching channel 9 preferably contains a single continuous linear shoe glove stitching 9*a* along continuous stitching channel base floor 9*b*. In the preferred embodiment shoe glove stitching 9*a* may further attach a second hook and loop fastener material segment 7*b* to composite shoe glove sole 4, see infra.

Shoe glove continuous stitching 9*a* is preferably made of cotton thread, but nylon threaded is also satisfactory. As best seen in FIGS. 2A and 2B, shoe glove stitching 9*a* preferably completely pierces and (i) attaches and sandwiches shoe glove cover exterior edge 1*m* to and between vertically aligning upper and lower shoe glove sole components 4*c*, 4*d* and (ii) thereby attaches upper and lower shoe glove sole components 4*c*, 4*d* respectively to each other and intervening continuous shoe glove cover opposing segments of exterior edge 1*m*. Each individual stitch 9*c* of shoe glove stitching 9*a* is preferably one-eighth inch in longitudinal linear length.

As best seen in FIG. 5, adhesive 12 is preferably applied as a single one-sixteenth inch thick upper adhesive layer 12*a* between (i) upper shoe glove sole component lower surface 4*jj* and (ii) shoe glove interior surface 1*e* at and proximal to opposing segments 1*mm*, 1*mmm* of shoe glove exterior cover edge 1*m*. A single second adhesive layer 12*b*, preferably one-eighth inch in thickness, is preferably placed between lower shoe glove sole component upper surface 4*g* and shoe glove cover exterior surface 1*d* at and proximal to opposing segments 1*mm*, 1*mmm* of shoe glove exterior cover edge 1*m*.

As best seen in FIGS. 2A, 2B and 4, stitching channel 9 protects shoe glove stitching 9*a* from excessive wear whenever shoe glove 1 is worn on footwear item 10. With this most preferred approach, first uppermost shoe glove sole component 4*c* attaches to upper shoe glove upper cover exterior edge 1*m* with adhesive 12 that reinforces shoe glove stitching 9*a*. Furthermore, stitching 9*a* within stitching channel 9*b* does not lie flush with or above lower shoe glove lower sole component lower surface 10*gg*. As a result, stitching channel 9 prevents excessive wear because linear continuous stitching 9*a* does not contact surfaces such as the ground or floor when in use. However in other embodiments, although not exclusively, there may be only adhesive, only stitching 9*a* without stitching channel 9, or other combinations of these features or lack thereof.

II. Modified Footwear Item 10

Figure 7:
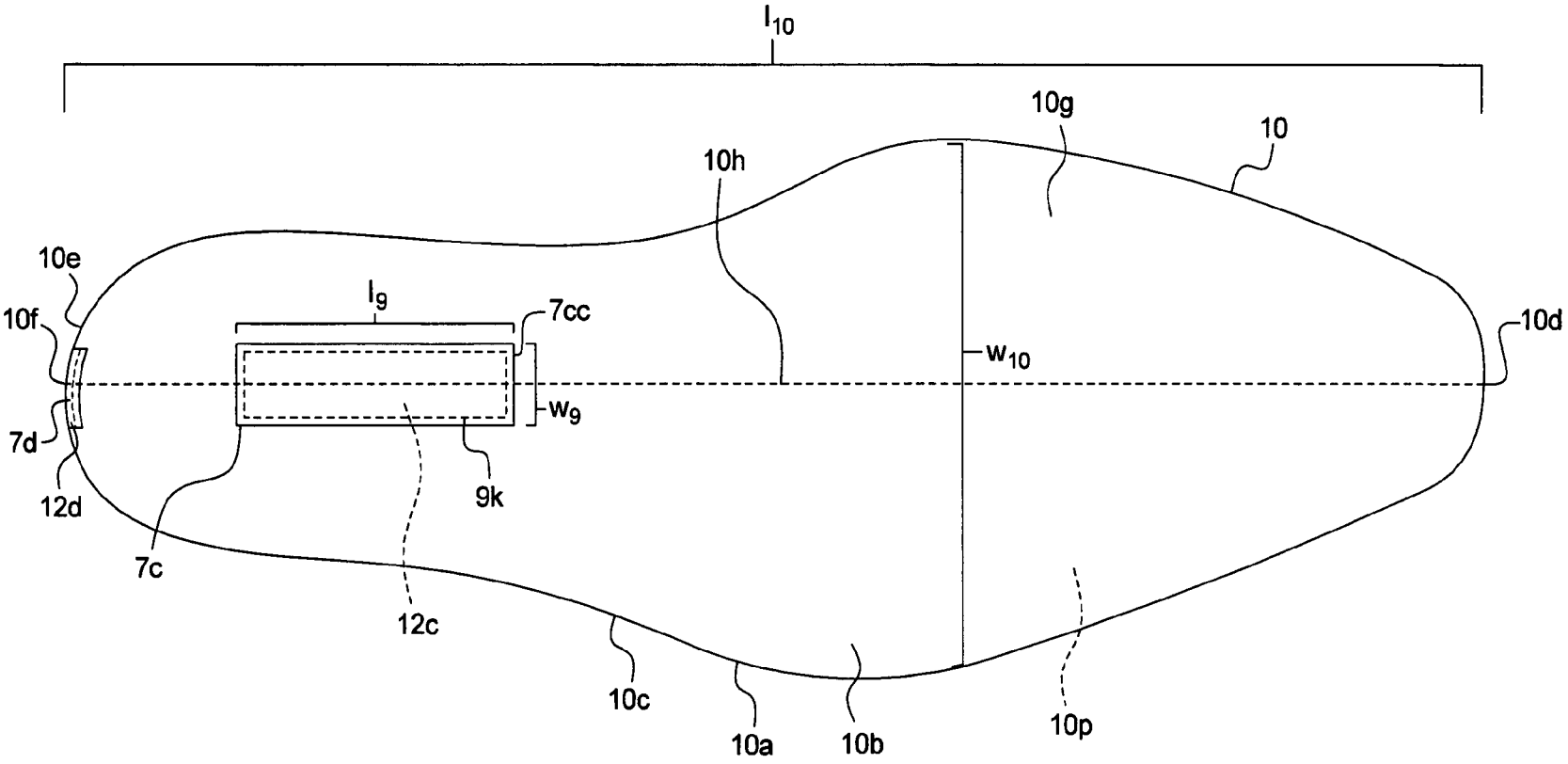
FIG. 7 illustrates a lower plan view of a footwear item with attached hook and loop material fastener segments.

Hook and loop fastener material segments 7 attached shoe glove 1 to a footwear item 10 in the more preferred embodiment. In a more preferred embodiment a single footwear item 10 also comprises (i) attaching devices 20 that are (ii) preferably hook and loop fastener material segments 7. As best seen in FIG. 7, most preferably footwear item 10 preferably have (i) a single footwear item sole 10*a* with a footwear lower sole surface 10*b* (ii) a single footwear upper sole surface 10*p* and (iii) a single footwear item sole exterior edge 10*c*. Footwear item 10 also has (i) a single anterior footwear end 10*d* and (ii) a single posterior footwear end 10*e*. A single footwear item 10 also has (i) a single footwear longitudinal midline 10*h* that is (ii) parallel to the longitudinal length l10 of footwear item 10 and (iii) bisects footwear item 10 into two equal longitudinal first and second footwear portions 10*g* and 10*k* respectively. Footwear item 10 also has (i) a width w (ii) a maximum width w10 (iv) footwear exterior surface 10*i* and (v) footwear interior surface 10*t*.

Figure 6:
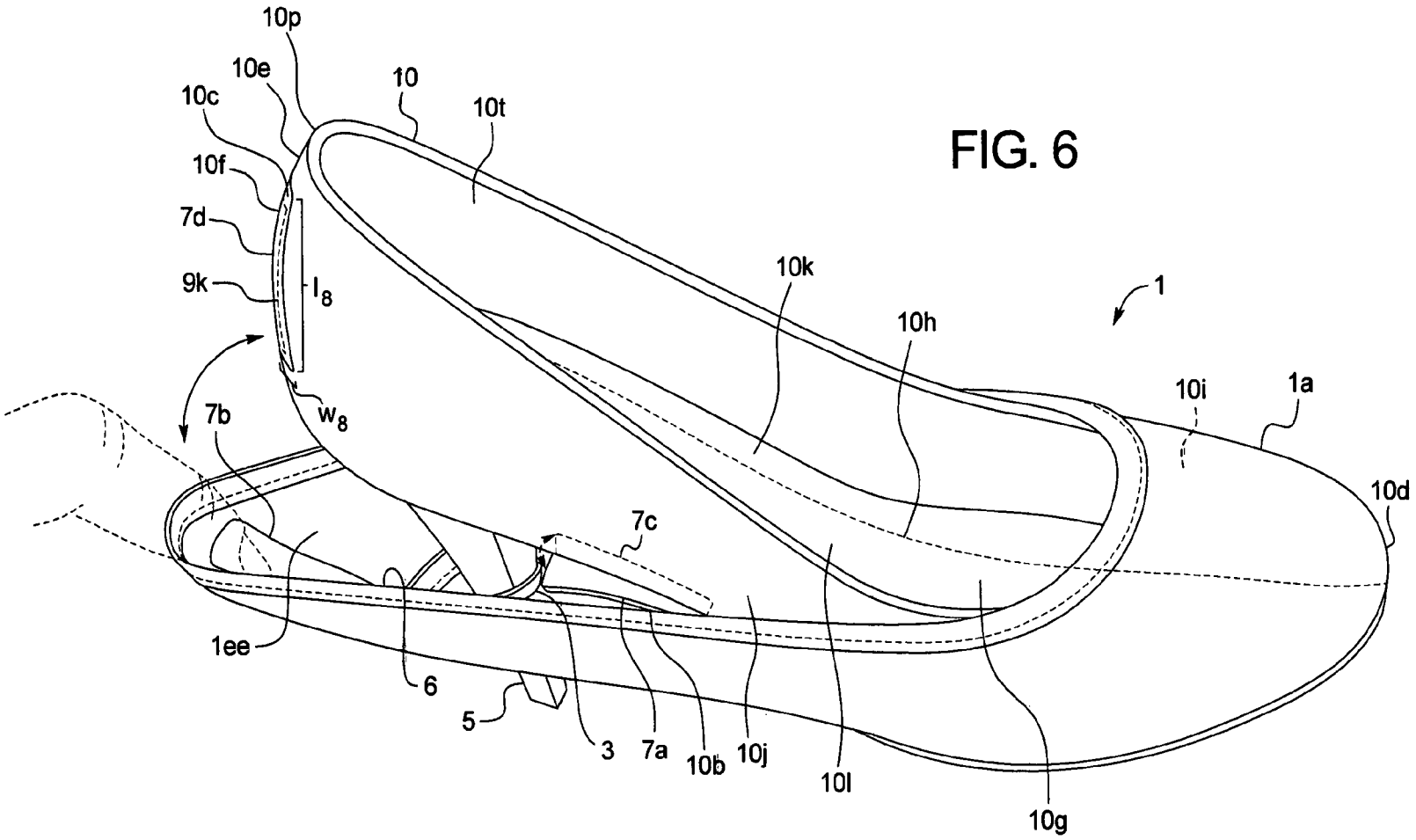
FIG. 6 illustrates a partial lateral view of the shoe glove of FIG. 1 that is in the process of placement upon a footwear item.

Referring to FIGS. 6 and 7, in the most preferred embodiment and when properly aligned, shoe glove 1 and footwear item 10 mechanically, reversibly and interchangeably attach to each other by hook and loop fastener material segments 7. Most preferably a single first hook and loop fastener material segment 7*a* attaches to a single third hook and loop fastener material segment 7*c* along footwear longitudinal sole midline 10*h*. Footwear longitudinal sole midline 10*h* preferably bisects footwear item sole 10*a* into two equal longitudinal sole portions 10*k*, 10*g*. Reversible attachment of hook and loop fastener material segments 7*a*, 7*c* to each other assists in more snugly attaching shoe glove 1 to footwear item 10. However, in other embodiments there is no attachment of hook and loop fastener material segments 7*a*, 7*c* to each other, and segments 7*a*, 7*c* are absent. In still other embodiments third hook and loop fastener material segment 7*c* reversibly attaches to footwear item 10 in a position other than along longitudinal footwear sole midline 10*h*.

Referring to FIG. 7, single third hook and loop fastener material segment 7*c* is preferably (i) one-eighth inch in width w9 (ii) two inches in longitudinal length l9 and (iii) one-eighth inch in thickness. Most preferably third hook and loop fastener material segment 7*c* permanently (i) longitudinally attaches to footwear item lower sole surface 10*b* (ii) along longitudinal footwear item sole midline 10*h* with stitching 9*k* and third adhesive layer 12*c*.

Single third hook and loop fastener material segment 7*c* is preferably positioned (i) seven to ten inches from footwear item anterior end 10*d* (ii) when measured from segment edge 7*cc* of segment 7*c* closest to footwear item anterior end 10*d*. In other embodiments, or in combination with other embodiments, third hook and loop fastener material segment 7*c* permanently longitudinally attaches to posterior footwear lower sole surface 10*b* along longitudinal footwear item sole longitudinal midline 10*h* exclusively by either third adhesive layer 12*c* or stitching 9*k*, but not both simultaneously.

In still other embodiments, or in combination with other embodiments, there is an absence of a third hook and loop fastener material segment 7*c* along footwear item 10. In still other embodiments, or in combination with other embodiments, third hook and loop fastener material segment 7*c* reversibly attaches to footwear item 10 (i) along footwear item sole longitudinal midline 10*h* or (ii) along another location upon footwear item 10. In still other embodiments, or in combination with other embodiments, third hook and loop fastener material segment 7*c* (i) reversibly attaches to an attaching device 20 upon shoe glove 1 where (ii) attaching device 20 is not a hook and loop fastener material segment 7. Attaching devises 20, including but not exclusively hook and loop fastener material segments 7, (i) attach a single footwear item 10 to a corresponding single shoe glove 1 and thereby assist in (ii) preventing slipping that occurs between enclosed attached footwear item 10 and (iii) maintaining a snug fit upon footwear item 10.

Still referring to FIGS. 6 and 7, most preferably when shoe glove 1 and footwear item 10 are properly aligned (i) a single footwear item fourth hook and loop fastener material segment 7*d* (ii) reversibly attaches to single corresponding second hook and loop fastener material segment 7*b*. Footwear item fourth hook and loop fastener material segment 7*d* is preferably (i) two and three-eighths inches in longitudinal length l8 (ii) one-eighth inch to one-quarter inch in width w8 and (iii) one-eighth inch in thickness. Fourth hook and loop fastener material segment 7*d* preferably permanently and congruently attaches to (i) footwear posterior vertical midline 10*f* along footwear item exterior surface 10*i* (ii) one-quarter inch from footwear heel upper exterior edge 10*p* (vi) by stitching 9*k* and/or fourth adhesive layer 12*d*. The reversible attachment of second and fourth hook and loop fastener material segments 7*b*, 7*d* respectively to each other assists in preventing shoe glove 1 from slipping from enclosed footwear item 10.

In other embodiments, or in combination with other embodiments, fourth hook and loop fastener material segment 7*d* attaches to footwear posterior vertical midline 10*f* exclusively by either (i) adhesive 12 or stitching 9*k* (ii) but not both adhesive 12 and stitching 9*k* simultaneously. In still other embodiments or in combination with other embodiments, there is an absence of a footwear item fourth hook and loop fastener material segment 7*d* along footwear item 10. In still other embodiments, or in combination with other embodiments, fourth hook and loop fastener material segment 7*d* reversibly or permanently attaches to footwear item 10 at another location upon footwear item 10 other than footwear item lower sole surface 10*b* along footwear item sole longitudinal midline 10*h*. In still other embodiments, or in combination with other embodiments, fourth hook and loop fastener material segment 7*d* permanently or reversibly attaches to footwear item 10 with fastening devices 20 that are not hook and loop material fastener segments 7.

In still other embodiments, or in combination with other embodiments comprising exclusively a pre-selected footwear item 10 and shoe glove 1 there is, but not exclusively (i) no attachment of first and third hook and loop fastener material segments 7*a*, 7*c* respectively and these segments 7*a*, 7*c* are therefore absent. In still other embodiments, or in combination with other embodiments, there is no attachment of second and fourth hook and loop fastener material segment 7*b*, 7*d* to each other, and segments 7*b*, 7*d* are therefore absent. In other embodiments, only hook and loop fastener material segments 7*b*, 7*d* are present, while in still other embodiment's only segments 7*a*, 7*c* are present. In still other embodiments of the invention (i) a plurality of hook and loop fastener material segments 7 that total more than four segments 7 are present or (ii) hook and loop fastener material segments 7 are completely absent. In other embodiments, or in combination with other embodiments, although not exclusively attaching devices 20 can be magnetic devices that are well known in the industry.

In other embodiments or in combination with other embodiments, although not exclusively, more than four attaching devices 20 that do not comprise hook and loop fastener material segments 7 for footwear item 10 and shoe glove cover 1*a* are satisfactory. Also satisfactory are (i) other locations along shoe glove 1 and pre-selected footwear item 10 for aligning hook and loop fastener material segments 7 to each other as well as (ii) other numbers of aligning hook and loop fastener material segments 7 and/or attaching devices 20 attaching shoe glove 1 to footwear item 10. In still other embodiments hook and loop fastener material segments 7 may be (i) other shapes and/or dimensions and/or (ii) reversibly attach to shoe glove 1 and footwear item 10.

II. Assembly of Shoe Glove 1 and Modified Footwear Item 10

Figure 8:
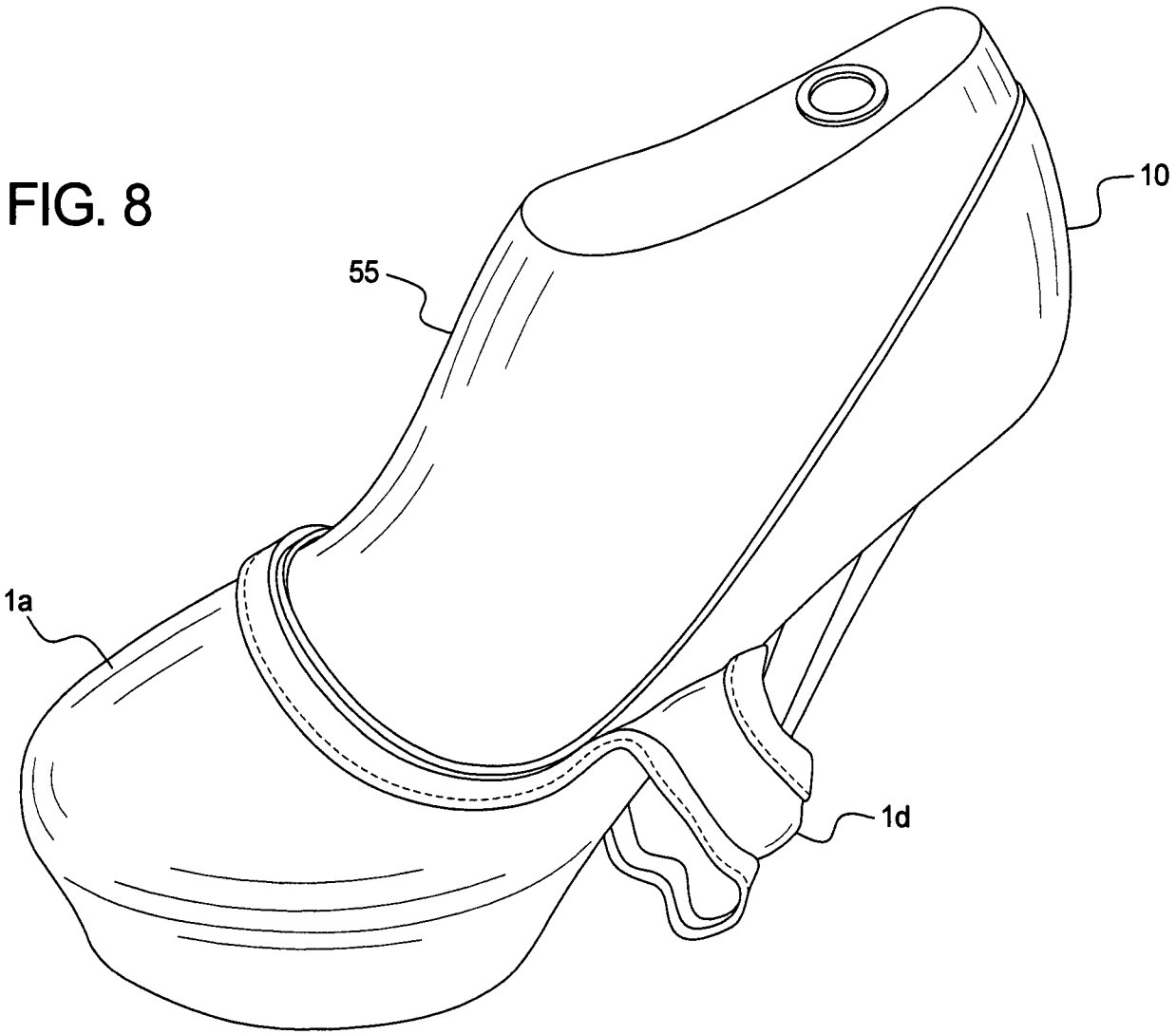
FIG. 8 illustrates a partial anterior view of a shoe glove cover with (i) its interior surface exposed exteriorly upon a footwear item (ii) over a shoe last.

Referring to FIGS. 5 and 8, assembly of the shoe glove 1 and modified footwear item 10 preferably proceeds as follows:

1. A shoe last 55 within a pre-selected footwear item 10 with the appropriate contours and dimensions is initially prepared. In the footwear industry a 'shoe last' is (i) a standard tool that comprises a plastic mold in the shape of a foot, and (ii) onto which the pre-selected footwear item 10 is initially positioned for proper fitting of a particular shoe glove cover 1.

2. Appropriate stretchable material 1*c* is severed using a pattern for the shoe glove cover 1*a*, and there is an initial fitting of the resulting shoe glove cover 1*a* upon the shoe last.

3. Piping 2*b* along shoe glove longitudinal opening 6 and exterior piping 2*a* for circular heel opening 3 are each stitched to shoe glove cover 1*a*. The shoe glove cover 1*a* and attached pipings 2*a*, 2*b* are then removed from the last.

4. The shoe cover 1*a* with stitched piping 2*a*, 2*b* is then (9*i*) repositioned on the footwear item 10 upon shoe last 55 (ii) so shoe glove cover interior surface 1*e* is oriented exteriorly and away from combined footwear item 10 and shoe last 55. In other words shoe glove cover 1*a* is placed along pre-selected footwear item 10 in an 'inside-out' orientation with respect to footwear item 10 upon shoe last 55.

5. A single upper shoe glove sole component 4*c* and a single lower shoe glove sole component 4*d* are then cut to the desired shape and dimensions using standard methods in the footwear industry.

6. A single stitching channel 9 is imprinted or cut approximately one-eight to three-eights inch from continuous exterior edge 4*m* of lower shoe glove sole component lower surface 4*gg*. Stitching channel 9 does not completely penetrate lower shoe glove sole component 4*d*.

7. While positioned upon footwear item 10 and combined shoe last 55, a first thin layer of shoe glove liquid adhesive 12*a*, of approximately ¼ ounce to one-half ounce and preferably one-sixteenth inch in thickness, is placed upon upper shoe glove sole component lower surface 4*jj* while shoe glove cover remains in an 'inside out' configuration upon footwear item 10 upon shoe last 55.

8. Upper shoe glove sole component lower surface 4*jj* and first adhesive layer 12*a* are then compressed to shoe glove cover interior surface 1*e* at and proximal to shoe glove cover exterior opposing edges 1*mm*, 1*mmm*.

9. Adhered shoe cover 1*a* and shoe glove upper sole component 4*c* are then placed under a heat lamp for approximately 30 minutes to allow first layer of shoe glove liquid adhesive layer 12*a* to dry and/or cure.

10. The partially assembled shoe glove 1 is then reconfigured so shoe glove cover exterior surface 1*d* is now oriented exteriorly and away from combined footwear item 10 and shoe last 55. A second layer of shoe glove liquid adhesive 12*b*, of approximately ¼ ounce to one-half ounce, and one-eight inch in thickness, is then applied to single shoe glove lower sole component upper surface 4*g*.

11. Lower shoe glove sole component upper surface 4*g* and second adhesive layer 12*b* are then compressed to shoe glove cover exterior surface 1*d* at shoe glove cover exterior opposing edges 1*mm*, 1*mmm* and external surface 1*d* proximal to edges 1*mm*, 1*mmm*.

12. (i) Adhered shoe cover 1*a* with previously adhered shoe glove upper sole component 4*c* and (ii) shoe glove lower sole component 4*d* with adhesive layer 12*b* are then placed under a heat lamp for approximately 30 minutes to allow second layer of shoe glove liquid adhesive 12*b* to dry and/or cure.

13. The adhered shoe glove components are then removed from shoe last 55 and combined footwear item 10.

14. Upper shoe glove sole component 4*c* and lower shoe glove sole component 4*d* are then stitched to each other in substantially vertical alignment, as seen in FIG. 3 and with intervening shoe glove cover exterior edge 1*m*, through stitching channel 9*a*.

15. First and second hook and loop fastener material segments 7*a*, 7*b* are prepared as follows:

(i) Stitching and/or adherence of first hook and loop fastener material segment 7*a* to shoe glove upper sole component upper surface 4*j* along shoe glove longitudinal sole midline 4*h*.

(ii) Stitch and/or adhere second hook and loop fastener material segment 7*b* to shoe cover posterior interior surface 1*ee* along shoe glove posterior vertical midline 1*ff*.

16. A single corresponding footwear item 10 is modified as follows:

(i) A single third hook and loop fastener material segment 7*c* is prepared to the correct dimensions and is thereafter stitched and/or adhered to a single corresponding footwear item lower sole surface 10*b*.

(ii) A single fourth hook and loop fastener material segment 7*d* is prepared to the appropriate dimensions and is thereafter stitched and/or adhered to the corresponding single foot item exterior surface posterior vertical midline 10*f*.

The consumer can also modify footwear item 10 with attaching devices 20, or preferably with hook and loop fastener material segments 7, from a pre-assembled shoe glove kit containing (i) adhesive 12 and (ii) at least four hook and loop fastener material segments 7 and (iii) at least one shoe glove 1. For the preferred kit the adhesive 12 is master cement adhesive of industrial strength.

In other embodiments of a kit, the consumer may use (i) adhesive 12 to permanently attach fastening devices 20 (that includes, but not exclusively, hook and loop fastener material segments 7) to a footwear item 10 and/or (ii) stitch the fastening devices 20 to the shoe with thread 9*b* from the kit. In other embodiments, the consumer may purchase a pre-selected footwear item 10 that is previously (i) fitted with attaching devices, such as hook and loop fastener material segments 7. In other embodiments the kit comprises (i) industrial strength master cement adhesive 12 (ii) hook and loop material fastener segments 7 (iii) thread as described supra 9*c*, and (iv) at least one shoe glove 1 of the appropriate size.

In still other embodiments or in combinations with other embodiments, a shoe glove kit comprises attaching devices 20 that that either permanently or reversibly attach to the pre-selected footwear item 10 and/or shoe glove 1. When fasteners 20 are reversibly attached to footwear item 10, adhesive 12*d* is one that is physically removable from footwear item 10, or (ii) is otherwise reversible in adhering properties or (iii) a reversible adhesive 12*e* or magnetic device 12*f* is previously applied to fasteners 7, 20. Adhesives 12*e* and magnetic devices 12*f* are well known in the industry.

In still other embodiments, or in combination with other embodiments, the shoe glove kit comprises attaching devices 20 that permanently or reversibly attach to other positions along the shoe glove 1 and/or pre-selected footwear item 10, so attaching devices 20 attach the shoe glove 1 to the footwear item in a reversibly interchangeable manner.

The invention claimed is:

1. A shoe glove assembly comprising:

a shoe and a shoe glove;

said shoe glove comprising:

a flexible upper cover, a composite sole, and three fasteners;

wherein said composite sole is directly attached to said upper cover with said three fasteners, said three fasteners comprising two adhesive components and one mechanical component;

wherein said composite sole includes an upper sole component and a lower sole component;

wherein said upper cover includes a lower peripheral edge that is folded inwardly and is at least partially disposed between said upper sole component and said lower sole component;

wherein said upper sole component, said lower peripheral edge, and said lower sole component are collectively attached together via said mechanical component and said two adhesive components;

said shoe glove further comprising a first hook-and-loop fastener segment and a second hook-and-loop fastener segment;

said first hook-and-loop fastener segment is directly attached to an upper surface of said upper sole component;

said shoe glove further comprising a heel opening that includes an anterior edge, wherein said first hook-and-loop fastener segment is contiguous with said anterior edge, wherein said heel opening is configured to allow a heel of the shoe to extend therethrough;

said composite sole including a longitudinal axis extending from a toe end of the composite sole to a heel end of the composite sole;

said first hook-and-loop fastener segment is aligned with and coincident with said longitudinal axis;

said shoe glove including a posterior interior surface with a vertical midline, said second hook-and-loop fastener segment is directly attached to said posterior interior surface and is aligned with and coincident with said vertical midline;

said shoe comprising: a third hook-and-loop fastener segment directly attached to a bottom exterior surface of the shoe and a fourth hook-and-loop fastener segment directly attached to a rear exterior surface of the shoe;

said first hook-and-loop fastener segment configured to reversibly attach to said third hook-and-loop fastener segment, and said second hook-and-loop fastener segment configured to reversibly attach to said fourth hook-and-loop fastener segment, thereby providing said shoe glove capability to be reversibly attachable to said shoe.

* * * * *